US007730828B2

(12) United States Patent
Ottliczky et al.

(10) Patent No.: US 7,730,828 B2
(45) Date of Patent: Jun. 8, 2010

(54) ROTOR RECESS WITH SCUPPER SLOTS AND FREE CASTING

(75) Inventors: Emmerich Ottliczky, Forchtenberg (DE); Franz Ratzky, Elztal (DE); Norbert Ries, Külsheim (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 283 days.

(21) Appl. No.: 11/722,608

(22) PCT Filed: Nov. 29, 2005

(86) PCT No.: PCT/EP2005/012708

§ 371 (c)(1),
(2), (4) Date: Aug. 15, 2007

(87) PCT Pub. No.: WO2006/072293

PCT Pub. Date: Jul. 13, 2006

(65) Prior Publication Data

US 2008/0202330 A1 Aug. 28, 2008

(30) Foreign Application Priority Data

Dec. 22, 2004 (DE) ..... 10 2004 061 777

(51) Int. Cl.
*F01B 31/08* (2006.01)

(52) U.S. Cl. ..... 92/186

(58) Field of Classification Search ..... 92/186
See application file for complete search history.

(56) References Cited

U.S. PATENT DOCUMENTS

| | | | | |
|---|---|---|---|---|
| 1,675,174 | A | 6/1928 | Hartog | |
| 3,805,677 | A * | 4/1974 | Clary et al. | 92/186 |
| 4,428,330 | A * | 1/1984 | Shimizu | 92/186 |
| 6,973,723 | B2 * | 12/2005 | Cagney et al. | 92/186 |
| 2002/0465931 | | 4/2002 | Ribeiro | |

FOREIGN PATENT DOCUMENTS

| | | |
|---|---|---|
| EP | A0529714 | 3/1993 |
| JP | 08121243 | 5/1996 |
| JP | 09112342 | 4/1997 |

OTHER PUBLICATIONS

International Search Report dated Mar. 15, 2006.
Preliminary International Report on Patentability, International file No. PCT/EP2005/012708.
International Searching Authority, International file No. PCT/EP2005/012708.

* cited by examiner

*Primary Examiner*—Michael Leslie
(74) *Attorney, Agent, or Firm*—YoungBasile, PC

(57) ABSTRACT

A piston for an internal combustion engine includes a piston head provided with an annular field, and a piston shaft arranged beneath the annular field. The piston shaft has shaft surfaces and a recess surface which is arranged around a bolt borehole and set back in relation to an outer diameter of the piston. At least one cavity is provided in the region of the lowest annular groove for oil flow in the direction of the recess surface during the movement of the piston and the at least one cavity is arranged outside an especially stressed region above the bolt borehole.

5 Claims, 2 Drawing Sheets

ROTOR RECESS WITH SCUPPER SLOTS AND FREE CASTING

The invention relates to a piston for a combustion engine.

BACKGROUND

Pistons of combustion engines which have a piston crown with a ring belt and piston skirt located below same are known. Such pistons are also designated, for example, as box pistons or pistons with a box design. It is known that in the area of the piston skirt a piston pin bore is present where a recess surface is configured around the piston pin bore which is set back compared to the outer diameter of the piston. It is further known that in the area of the lowest ring groove within the ring belt of the piston at least one depression is present by way of which the oil collected by the lowest ring while the piston is operating is collected and taken by way of the recess area towards the lower edge of the piston skirt. It has turned out that while the known pistons are operating, depressions of this type are located above the piston pin bore such that they are in a particularly stressed area. This particularly stressed area of the piston is located to the right and left next to the highest point of the piston pin bore since the piston, in particular the piston crown, deforms around the piston pin located in the piston pin bore during operation. If the recesses are in this particularly stressed area, the recesses create a design fracture point so that cracks occur when the piston is operating, particularly when used in today's highly stressed diesel combustion engines.

It would be desirable to find a remedy for this problem.

SUMMARY

A piston with at least one depression located outside the particularly stressed area above the piston pin bore and thus approximately at the edge of the recess area in the transition zone to the skirt surface, where the particular stressed area extends towards the lower edge of the ring belt, starting from a highest point of the pin bore. On the one hand, the effect of the depression is retained because the oil collected by the oil scraper ring in the last ring groove can be directed downwards by way of the recess area. On the other hand, cracking is effectively prevented because the at least one depression is located in such an area in the upper area of the recess surface around the piston pin bore which is not particularly stressed.

Supplemental to this of the invention, an enlargement is provided in a transition area from the depression towards the recess surface which is also set back behind the outer diameter of the piston. The onset of cracking is thereby further effectively prevented, where such an enlargement can also contribute to locating the depression in an area next to the highest point of the piston pin bore which can still be particularly stressed.

In a further aspect, the surfaces set back compared to the outer diameter of the piston, which may be the at least one depression, the enlargement and the entire recess surface around the piston pin bore, can be produced at least partially, and in particular, completely, in free casting and/or by metal-removing machining. If the set-back surfaces are produced in free casting, the negative mold form of the piston, or of the piston blank, has projecting areas which form the set-back areas after the piston blank is cast. This has the advantage that a mold form has to be produced only once with the corresponding projecting areas which then form the set-back areas with each casting of a piston blank. Supplementally or as an alternative thereto, it is conceivable that a piston blank with a constant and continuous diameter can be cast and the set-back surfaces are removed subsequently during fine machining by metal-removing machining. This is a choice, in particular, when numerically controlled machines (CNC machines) are used during fine machining of the piston. When producing the set-back surfaces, absolute care must be taken that the transitions from lower lying surfaces, where the reference is the outer diameter of the piston, are rounded to prevent design fracture points which would permit a crack while the piston is operating.

BRIEF DESCRIPTION OF THE DRAWING

Aspects of the invention to which it is, however, not restricted, are described in the following description and explained using the drawing in which.

DETAILED DESCRIPTION

Figure 1:
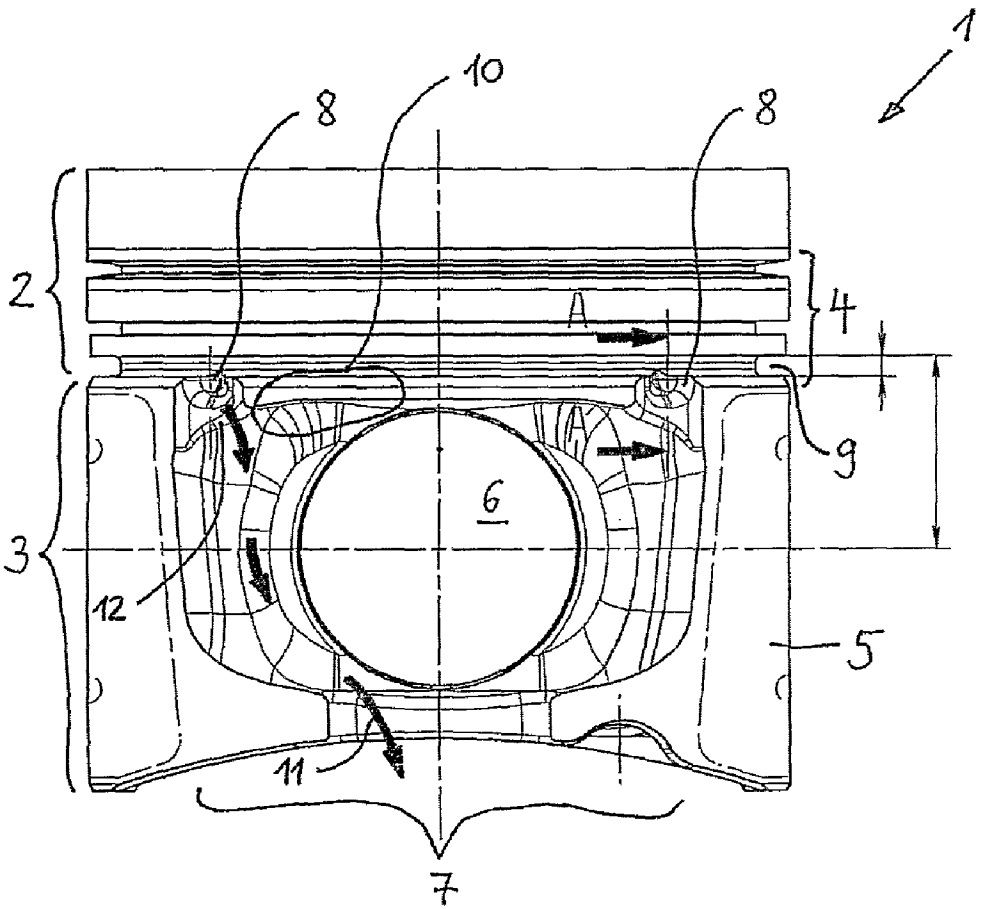
FIG. 1 is a first aspect view of a piston.

FIG. 1 shows a one-piece piston 1 of box design, where the piston 1 has a piston crown 2 (where applicable with a combustion bowl not shown here) and a piston skirt 3 located below the crown 2. Concerning the skirt 3, it should be pointed out that the invention can be used for any number of piston types, i.e., for articulated pistons as well.

The piston crown 2 has a ring belt known per se with usually three ring grooves, where the piston skirt has two diametrically opposed skirt surfaces 5 with which the piston 1 is supported against and guided along the cylinder bores during operation. Furthermore, the piston skirt 3 has a piston pin bore 6 to receive a piston pin with which the piston 1 is connected by way of a connecting rod not shown here. In the area around the piston pin 6 a recessed surface is provided which is set back behind the outside diameter of the piston 1, while the skirt surfaces lie on the outer diameter of the piston 1. At least one depression 8 with a plurality, i.e., four depressions is also possible present in the area of a lowest ring groove 9, where this depression 8 is also designated as a scupper slot. To the left of the highest point of the piston pin bore 6 an area particularly stressed during operation of the piston 1 is depicted in with the reference numeral 10, where this particularly stressed area 10 also exists to the right of the highest point of the piston pin bore 6. The effect of the depressions 8 is that the oil collected by the oil scraper ring located in the lowest ring groove 9 is taken away downward by way of the recess surface 7 next to the piston pin bore (when looking at FIG. 1) so that a flow of oil 11 results, as indicated by the arrows. The arrangement of the depressions 8 next to the particularly stressed area 10 has the advantage that cracks can no longer form in the area of the depressions since the material thickness is less here because of the set-back surfaces and crack formation would be a threat if the depressions 8 were located in the particularly stressed area 10. When looking at FIG. 1, it can be seen that the depressions 8 are located approximately above the area in which the recess surface 7 makes a transition into the skirt surfaces 5. To further effectively prevent cracking, an enlargement is provided at the transition from the depression 8 to the recess surface 7, where, depending on the geometric design (in particular the depth of the depression 8, the dimensioning of the enlargement 12 and the depth of the recess surface 7), the depression 8 can also be located in the boundary area (the area remote from the highest point of the pin hole).

Figure 2:
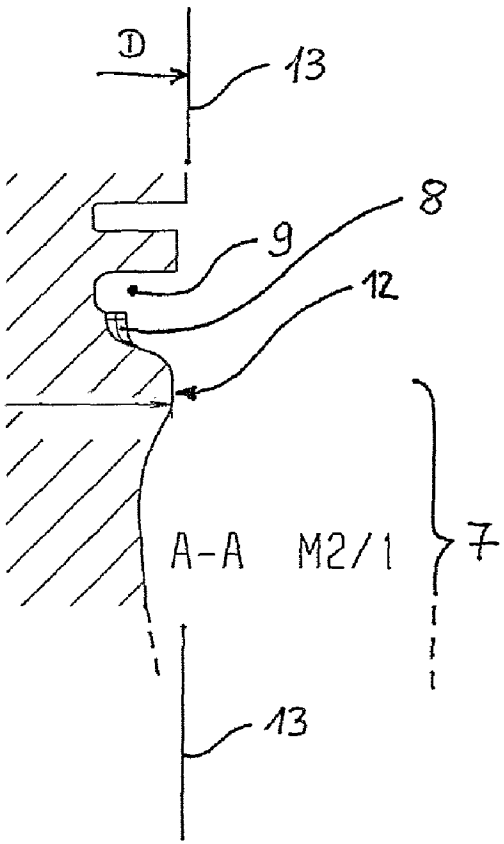
FIG. 2 is a cross section along line A-A scale 2:1, from FIG. 1.

For further clarification of the invention, reference is made to FIG. 2 which shows a cross section A-A from FIG. 1 at twice the scale. Here both the position of the depression 8, the lowest ring groove 9 and the enlargement 12 can be seen. These areas, just like the recess surface 7, are set back inward by comparison with an outer diameter D which has reference numeral 13. The dimension of the setback is determined by the geometric relationships and the distribution of forces, where the depth of the depression must be selected such that the oil collected by the oil scraper ring 9 located in the lowest ring groove can be removed by way of the transition area to the recess surface 7, in particular by way of the enlargement 12, in adequate quantities during the movement of the piston 1. To prevent cracking, the enlargement is reinforced, that is to say, it is set back less than the depression 8, or the recess surface 7, compared with the outer diameter D. In the aspect shown in FIG. 2 the transition areas from the lowest ring groove 9, or the depression 8, across the enlargement 12 towards the recess area 7 are rounded, just as, incidentally, the transition area from the recess surface 7 into the skirt surface 5. The enlargement 12 thus forms a buildup of material for reinforcement and prevention of cracking in this area, simultaneously ensuring the flow of oil 11 since it is set back from the outer diameter D. Normally the depression 8 is round in shape, which is realized, for example, by a drilled hole, but can also be produced by free casting. The width of the transition area from the depression 8 to the recess area 7 and thus the width of the enlargement 12 is preferably greater than the radial extent of the depression 8 to ensure an adequate flow of oil 11 towards the recess surface 7. It is also conceivable that this transition area has the same or a lesser width than that of the depression 8.

Figure 3:
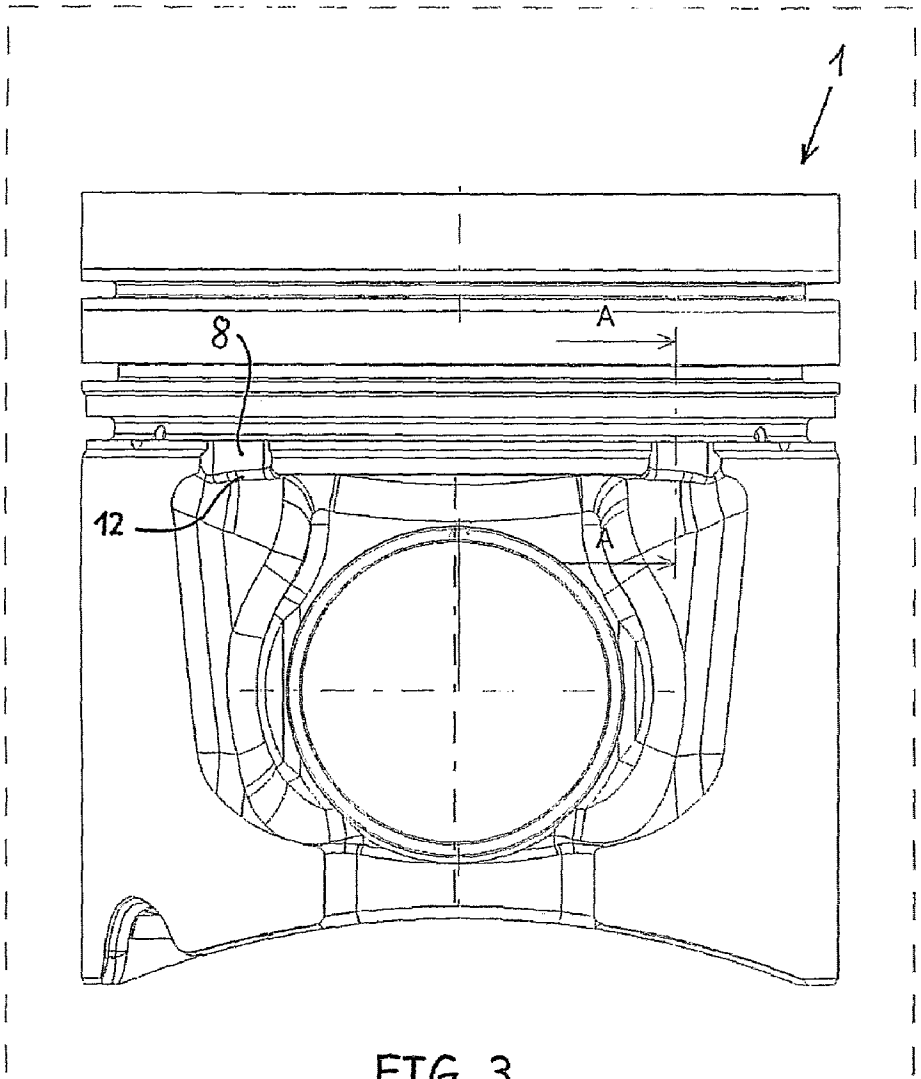
FIG. 3 is a further aspect of a piston.

FIG. 3 shows a further aspect where the depression 8 here is not round (for example, realized as a drilled hole) but rectangular in shape with rounded edges. Here too, the depressions 8 are again located outside the particularly stressed area 10, where the enlargement 12 is in the transition area from the depression 8 to the recess area 7. Such shapes for the depression 8, the enlargement 12 and the recess area 7, as shown in FIG. 3, can be produced in a particularly advantageous way in free casting. This, however, does not preclude metal-removing machining, in particular, fine machining following the production of these surfaces by casting.

Figure 4:
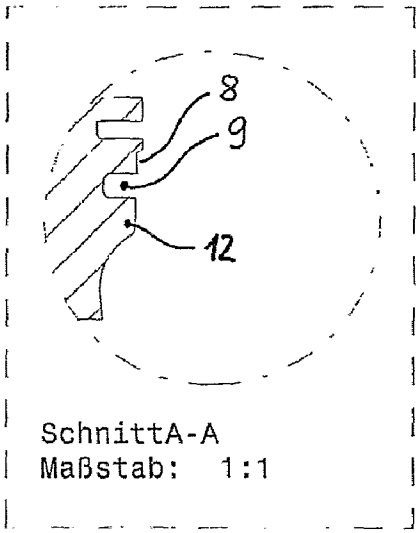
FIG. 4 is a cross section along line A-A, scale 1:1, from FIG. 3.

Supplemental to FIG. 3, reference is made to FIG. 4 which shows a cross section A-A to a scale of 1:1. Here it is very clear to see that the depression 8 is not only located in the area below the lowest ring groove 9 but extends beyond same.

The invention can be used with any piston 1 possible for a combustion engine, however, preferably with pistons of a lightweight material, such as aluminum, and then with larger capacity combustion engines, in particular, those which are used in trucks.

What is claimed is:

1. A piston for a combustion engine comprising:

a piston crown with a ring belt and a piston skirt located below the ring belt;

skirt surfaces and a recess surface located around a piston pin bore and set back with respect to an outer diameter of the piston;

at least one depression provided in an area of a bottommost ring groove for flow of oil towards the recess surface during the movement of the piston;

at least one depression located outside a particularly stressed area located above the piston pin bore, the at least one depression located where the recess surface makes a transition into the skirt surface and in a transition area toward the recess surface; and an enlargement set back behind the outer diameter of the piston.

2. The piston of claim 1, wherein the recess surface and the transition area set back with respect to the outer diameter of the piston are produced at least partially in free casting.

3. The piston of claim 1, wherein the recess surface and the transition area set back with respect to the outer diameter of the piston are produced at least partially by metal-removing machining.

4. The piston of claim 1, wherein the recess surface set back with respect to the outer diameter of the piston is produced at least partially in free casting.

5. The piston of claim 1, wherein the recess surface set back with respect to the outer diameter of the piston is produced at least partially by metal-removing machining.

* * * * *